US010728982B2

(12) United States Patent
Liu et al.

(10) Patent No.: US 10,728,982 B2
(45) Date of Patent: Jul. 28, 2020

(54) PWM DIMMING WITH REDUCED AUDIBLE NOISE

(71) Applicant: LEDVANCE GmbH, Garching bei Munchen (DE)

(72) Inventors: Yang Liu, Guangdong (CN); Kun Xiong, Guangdong (CN)

(73) Assignee: LEDVANCE GMBH, Garching bei Munchen (DE)

( * ) Notice: Subject to any disclaimer, the term of this patent is extended or adjusted under 35 U.S.C. 154(b) by 0 days.

(21) Appl. No.: 16/251,432

(22) Filed: Jan. 18, 2019

(65) Prior Publication Data

US 2019/0230759 A1 Jul. 25, 2019

(30) Foreign Application Priority Data

Jan. 19, 2018 (CN) ..... 2018 1 0053199

(51) Int. Cl.
*H05B 45/37* (2020.01)
*H05B 45/10* (2020.01)
*H05B 45/50* (2020.01)

(52) U.S. Cl.
CPC ..... *H05B 45/37* (2020.01); *H05B 45/10* (2020.01); *H05B 45/50* (2020.01)

(58) Field of Classification Search
CPC ..... H05B 33/0818; H05B 33/0845; H05B 33/0887; H05B 45/37; H05B 45/50; H05B 45/10; H05B 45/305
See application file for complete search history.

(56) References Cited

U.S. PATENT DOCUMENTS 8,093,825 B1 * 1/2012 Van Ess ..... H05B 45/14 315/291
2010/0194293 A1 * 8/2010 Deurenberg ..... H05B 33/0818 315/159
2011/0164069 A1 * 7/2011 Thompson ..... G09G 3/342 345/690
2014/0354170 A1 * 12/2014 Gredler ..... H05B 33/0815 315/224
2015/0282270 A1 * 10/2015 Loveridge ..... H05B 33/0845 315/224
2015/0327340 A1 * 11/2015 Siessegger ..... H05B 33/0818 315/200 R
2016/0212813 A1 * 7/2016 Li ..... H05B 33/0845
2017/0238380 A1 * 8/2017 Bannister ..... H05B 33/0812 315/224

* cited by examiner

*Primary Examiner* — Renan Luque
(74) *Attorney, Agent, or Firm* — Hayes Soloway PC

(57) ABSTRACT

Method and device for PWM dimming of an LED lamp. The LED lamp comprises one or more LEDs and an LED lamp driver for operating the LEDs. The method comprises: generating a PWM signal; and supplying the PWM signal to the LED lamp driver; wherein the PWM signal comprises a mixture of two or more different frequencies.

20 Claims, 2 Drawing Sheets

PWM DIMMING WITH REDUCED AUDIBLE NOISE

CROSS-REFERENCE TO RELATED APPLICATIONS AND PRIORITY

This patent application claims priority from CN Patent Application No. 201810053199.2 filed on Jan. 19, 2018, the disclosure of which is incorporated completely herein by reference.

TECHNICAL FIELD

The present invention relates to a method for PWM dimming of an LED lamp and a PWM dimming device for an LED lamp driver.

BACKGROUND

With the advent of LED lamps (LED being the abbreviation for light-emitting diode), efficient, safe and long-lived lighting means are available. Similar to other light sources the brightness of LEDs can be adjusted by dimming. For this purpose different technologies for dimming a lamp have been developed, including analog or linear dimming and PWM dimming (PWM being the abbreviation for pulse-width-modulation). Compared to methods of linear dimming, PWM dimming has advantages such as high efficiency and accuracy as well as no CCT shift (CCT being the abbreviation for correlated color temperature).

However, PWM dimming may cause audible noise originating from the inductor and capacitor of the LED lamp driver operated at the PWM frequency. The inductor and capacitor of the LED lamp driver resonate at the PWM frequency which, in turn, may cause vibrations of other components such as a printed circuit board of the LED lamp driver.

In order to reduce noise during PWM dimming, the LED lamp driver may be insulated against sound and/or vibration (potting). Alternatively, components of low noise may be used. However, these solutions incur additional costs and space in order to be effective.

SUMMARY OF THE INVENTION

It is an object of the present invention to provide a method for PWM dimming of an LED lamp and a PWM dimming device for an LED lamp driver capable of reducing audible noise, preferably in an efficient and/or cost-effective manner.

The object is solved by a method and a PWM dimming device according to the independent claims. Preferred embodiments are given by the dependent claims, the description and the drawings.

Accordingly, a method for PWM dimming of an LED lamp is provided. The LED lamp comprises one or more LEDs and an LED lamp driver for operating the LEDs.

According to the method a PWM signal is generated and supplied to the LED lamp driver. The PWM signal may be the electrical current for energizing the LEDs or a signal serving as the basis for modulating the electrical current for energizing the LEDs. Preferably, the PWM signal has a periodical wave form including temporal active and non-active portions. The brightness of the LEDs is adjusted by choosing or amending the PWM duty cycle, i.e. the fraction of one period (i.e. the time it takes for the PWM signal to complete an on-and-off cycle) in which the signal is active relative to the period in which the signal is non-active.

According to the method the PWM signal comprises a mixture of two or more different frequencies.

The above illustrated method for dimming an LED lamp significantly reduces audible noise when dimming the LED lamp compared with a method utilizing a conventional PWM signal having a single frequency. The noise reduction is achieved by temporally changing the PWM frequencies. Thus, the implementation of the method does not incur significant additional costs. A PWM dimming device implementing the method can be produced in a cost-effective manner. Further, no amendment or update of the circuit layout, for instance PCB-layout, of the LED lamp driver is required.

Preferably, the PWM signal is generated by an MCU which further simplifies the implementation of the method and improves flexibility, because the MCU facilitates the adjustment or amendment of the frequencies composing the PWM signal.

A possible mixture of frequencies having a good performance of noise reduction comprises one or more of the following frequencies: 1 kHz, 2 kHz, 4 kHz and 8 kHz.

A further improvement can be achieved by randomly or quasi-randomly changing the different frequencies within time.

Considering the response time of the human ear, it is preferable that one or more changes of the frequency occur within a time period of 100 ms to 150 ms, preferably within a time period of about 125 ms.

Further, a PWM dimming device for an LED lamp driver is provided. The PWM dimming device comprises a dimming circuit configured to generate a PWM signal and supplying the PWM signal to the LED lamp driver. The PWM signal comprises a mixture of two or more different frequencies.

All features that are disclosed with respect to the method for PWM dimming are also disclosed for the PWM dimming device. Moreover, the technical effects, preferred or optional features as well as technical contributions and advantages described with respect to the method for PWM dimming similarly apply to the PWM dimming device. This includes that the dimming circuit preferably comprises an MCU which is configured to generate the PWM signal.

BRIEF DESCRIPTION OF THE DRAWINGS

Preferred embodiments of the invention will be explained in the following, having regard to the drawings. It is shown in.

DETAILED DESCRIPTION OF THE INVENTION

Figure 1A:
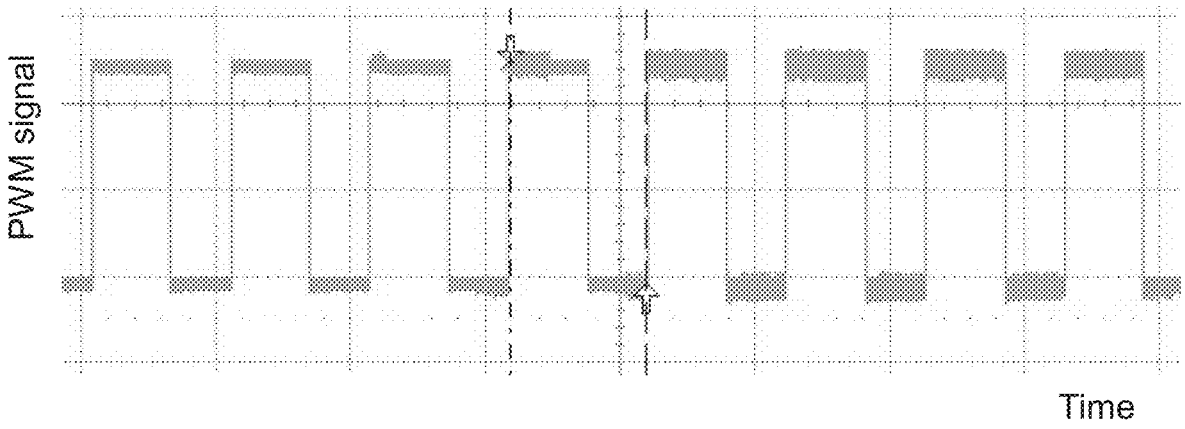
FIG. 1*a* shows a periodic PWM wave form having a frequency of 1 kHz.

In the following, preferred embodiments of the invention will be described with reference to the drawings. Here, elements that are identical, similar or have an identical or similar effect are provided with the same reference numerals in the figures. Repeating the description of such elements may be omitted in order to prevent redundant descriptions.

The figures and the size relationships of the elements illustrated in the figures among one another should not be regarded as to scale. Rather, individual elements may be illustrated with an exaggerated size to enable better illustration and/or better understanding.

FIG. 1*a* shows a typical periodic PWM wave form for dimming an LED lamp. In the present example the PWM wave form has a frequency of 1 kHz. The PWM wave form may be generated by an MCU (microcontroller unit) which may be part of an external device or an LED lamp driver for operating one or more LEDs. The LEDs are energized by supplying a current which is modulated according to the PWM wave form. The brightness of the LEDs is adjusted by amending the PWM duty cycle, i.e. the fraction of one period (i.e. the time it takes for the PWM signal to complete an on-and-off cycle) in which the signal is active relative to the period in which the signal is non-active.

Figure 1B:
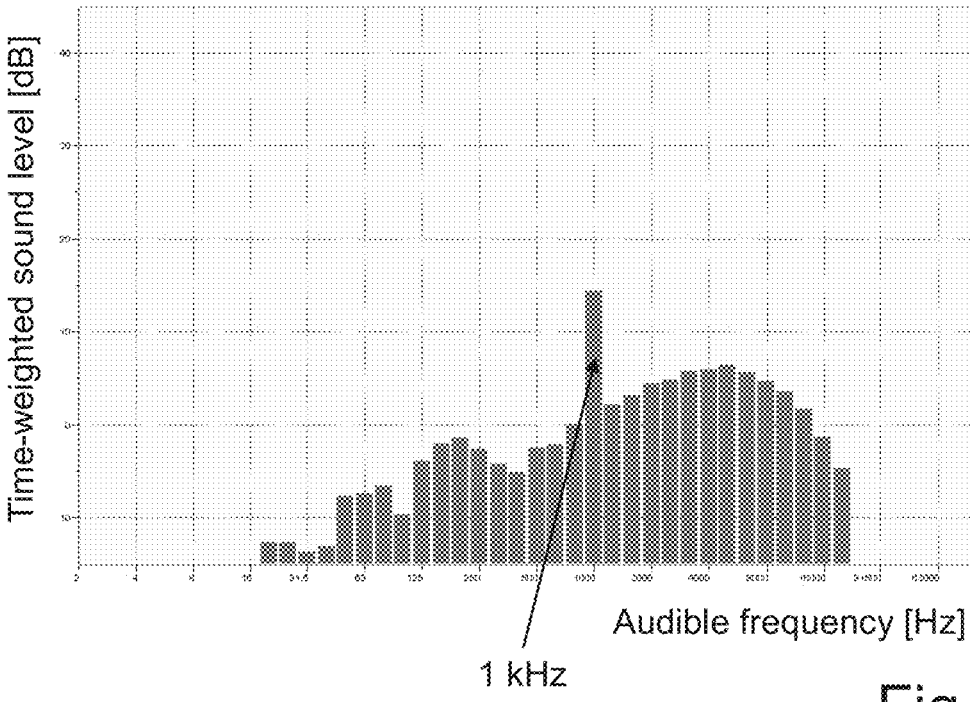
FIG. 1*b* shows an audible noise frequency spectrum obtained for the 1 kHz PWM wave form of FIG. 1*a* generated by an MCU.

FIG. 1*b* shows an audible noise frequency spectrum measured for a 1 kHz PWM signal of FIG. 1*a* generated by an MCU. The noise spectrum of FIG. 1*b* (as well as FIG. 2*b*) has been obtained using an electroacoustics sound level meter based on IEC61672. The x-axis of the spectrum represents the audible frequency and the y-axis represents the time-weighted sound level determined by the sound level meter.

The noise spectrum of FIG. 1*b* reveals a peak audible noise of 22.5 dB at the PWM frequency of 1 kHz.

Figure 2A:
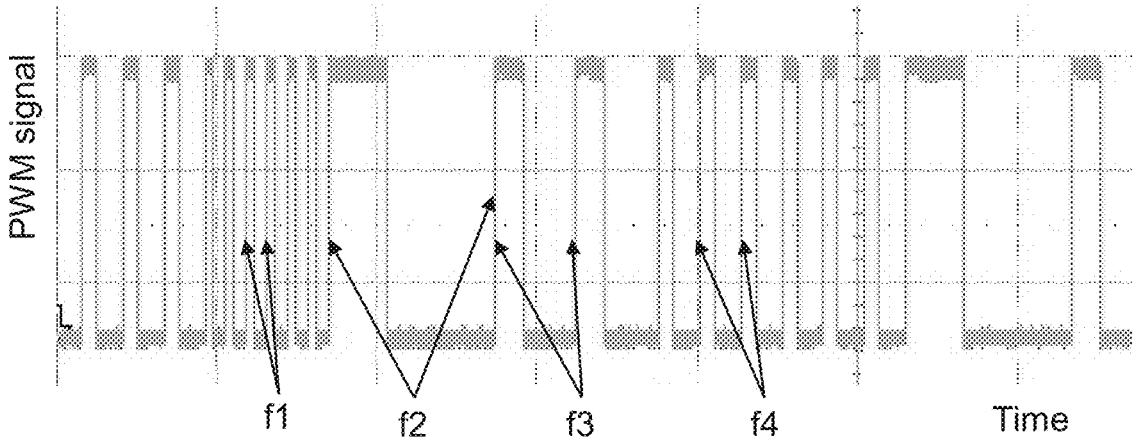
FIG. 2*a* shows a PWM wave form including a mixture of PWM frequencies.

In order to reduce the noise generated by applying a PWM signal for dimming, FIG. 2*a* illustrates a PWM wave form including a mixture of PWM frequencies. In the present example, a random change of PWM frequencies within a time period of 125 ms is performed. The set of frequencies exemplarily contains f1=8 kHz, f2=1 kHz, f3=2 kHz and f4=4 kHz. The time period in which one or more changes of frequencies occur may be amended; however a time period between 100 ms and 150 ms, preferably about 125 ms, is preferred, because this approximately corresponds to the response time of the human ear.

Figure 2B:
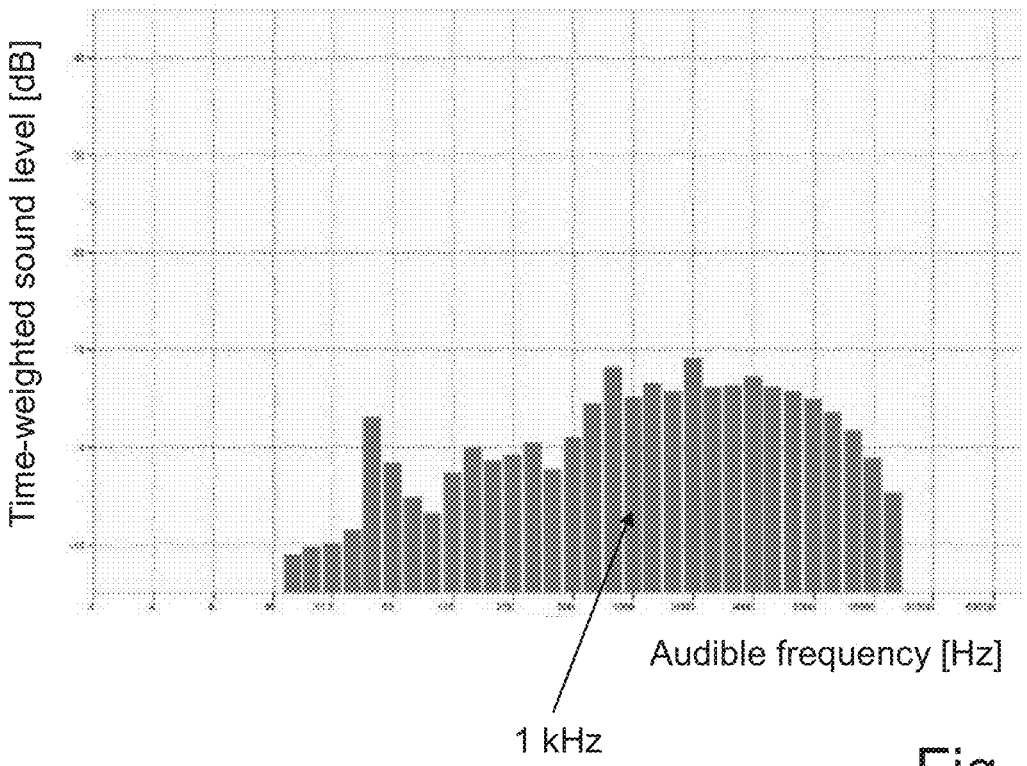
FIG. 2*b* shows an audible noise frequency spectrum obtained for the PWM wave form of FIG. 2*a* generated by an MCU.

FIG. 2*b* shows an audible noise frequency spectrum measured for a PWM signal of FIG. 2*a* generated by an MCU. The x-axis represents the audible frequency and the y-axis represents the time-weighted sound level determined by the sound level meter.

The noise spectrum of FIG. 2*b* reveals that no peak at a certain frequency is present. The mixture of PWM frequencies contributes to a dispersion of the noise to a range of frequencies within the spectrum. In particular, since 1 kHz in the present example only appears at 2/7*125 ms during the 125 ms time period, the noise at 1 kHz in the spectrum of FIG. 2*b* is significantly reduced compared with the spectrum of FIG. 1*b*. The largest noise of about 18.4 dB in the present example occurs at 2 kHz.

The above illustrated PWM dimming device for an LED lamp significantly reduces audible noise when dimming the LED lamp. Only standard electronic components are required for implementing the PWM dimming device. Moreover, the noise reduction is achieved by changing the PWM frequencies. Thus, the implementation of the presented technology for reducing noise does not incur significant additional costs. The PWM dimming device can be produced in a cost-effective manner. Further, no amendment or update of the PCB-layout of the LED lamp driver is required.

The invention is not restricted by the description based on the embodiments. Rather, the invention comprises any new feature and also any combination of features, including in particular any combination of features in the patent claims, even if this feature or this combination itself is not explicitly specified in the patent claims or exemplary embodiments.

LIST OF REFERENCE NUMERALS f1, f2, f3, f4 Frequencies

The invention claimed is:

1. A method for pulse width modulation (PWM) dimming of a light-emitting diode (LED) lamp, wherein the LED lamp comprises one or more LEDs and an LED lamp driver for operating the one or more LEDs, the method comprising:

generating a PWM signal comprising a mixture of two or more different PWM frequencies, wherein within each consecutive time period of 100-150 ms of the PWM signal, one or more changes of PWM frequency occur while maintaining a constant PWM duty cycle, and wherein the mixture of two or more different PWM frequencies comprises two or more of the following frequencies: 1 kHz, 2 kHz, 4 kHz, and 8 kHz; and supplying the PWM signal to the LED lamp driver.

2. The method according to claim 1, wherein the PWM signal is generated by a microcontroller unit (MCU).

3. The method according to claim 1, wherein the different PWM frequencies are randomly changed within the time period.

4. The method according to claim 1, wherein within the PWM signal, the one or more changes of the PWM frequency occur within a time period of about 125 ms.

5. A pulse width modulation (PWM) dimming device for a light-emitting diode (LED) lamp driver, wherein the PWM dimming device comprises a dimming circuit configured to:

generate a PWM signal comprising a mixture of two or more different PWM frequencies, wherein within each consecutive time period of 100-150 ms of the PWM signal, one or more changes of PWM frequency occur while maintaining a constant PWM duty cycle, and wherein the mixture of two or more different PWM frequencies comprises two or more of the following frequencies: 1 kHz, 2 kHz, 4 kHz, and 8 kHz; and supply the PWM signal to the LED lamp driver.

6. The PWM dimming device according to claim 5, wherein the dimming circuit comprises a microcontroller unit (MCU) which is configured to generate the PWM signal.

7. The PWM dimming device according to claim 5, wherein the different PWM frequencies are randomly changed within the time period.

8. The PWM dimming device according to claim 5, wherein within the PWM signal, the one or more changes of the PWM frequency occur within a time period of about 125 ms.

9. The PWM dimming device according to claim 5, wherein the PWM signal is an electrical current for energizing the one or more LEDs.

10. The PWM dimming device according to claim 5, wherein the PWM signal is a signal serving as the basis for modulating an electrical current for energizing the one or more LEDs.

11. The PWM dimming device according to claim 5, wherein:

the mixture of two or more different PWM frequencies comprises one or more each of the following frequencies: 1 kHz, 2 kHz, 4 kHz, and 8 kHz; and the different PWM frequencies are randomly changed within the time period.

12. The method according to claim 1, wherein the PWM signal is an electrical current for energizing the one or more LEDs.

13. The method according to claim 1, wherein the PWM signal is a signal serving as the basis for modulating an electrical current for energizing the one or more LEDs.

14. The method according to claim 1, wherein:

the mixture of two or more different PWM frequencies comprises each of the following frequencies: 1 kHz, 2 kHz, 4 kHz, and 8 kHz; and the different PWM frequencies are randomly changed within the time period.

15. The method according to claim 1, wherein the PWM signal has a periodic waveform including temporal active and non-active portions.

16. The PWM dimming device according to claim 5, wherein the PWM signal has a periodic waveform including temporal active and non-active portions.

17. A method for pulse width modulation (PWM) dimming of a light-emitting diode (LED) lamp, wherein the LED lamp comprises one or more LEDs and an LED lamp driver for operating the one or more LEDs, the method comprising:

generating a PWM signal comprising a mixture of two or more different PWM frequencies, wherein within the PWM signal, one or more changes of PWM frequency occur within a time period of 100 ms to 150 ms while maintaining a constant PWM duty cycle, and wherein the mixture of two or more different PWM frequencies comprises three or more of the following frequencies: 1 kHz, 2 kHz, 4 kHz, and 8 kHz; and supplying the PWM signal to the LED lamp driver.

18. The method according to claim 17, wherein the mixture of two or more different PWM frequencies comprises each of the following frequencies: 1 kHz, 2 kHz, 4 kHz, and 8 kHz.

19. A pulse width modulation (PWM) dimming device for a light-emitting diode (LED) lamp driver, wherein the PWM dimming device comprises a dimming circuit configured to:

generate a PWM signal comprising a mixture of two or more different PWM frequencies, wherein within the PWM signal, one or more changes of PWM frequency occur within a time period of 100 ms to 150 ms while maintaining a constant PWM duty cycle, and wherein the mixture of two or more different PWM frequencies comprises three or more of the following frequencies: 1 kHz, 2 kHz, 4 kHz, and 8 kHz; and supply the PWM signal to the LED lamp driver.

20. The PWM dimming device according to claim 19, wherein the mixture of two or more different PWM frequencies comprises each of the following frequencies: 1 kHz, 2 kHz, 4 kHz, and 8 kHz.

* * * * *